US005367958A

United States Patent [19]

Weiss et al.

[11] Patent Number: 5,367,958

[45] Date of Patent: Nov. 29, 1994

[54] TWO PIECE CENTER SILL SHROUD FOR RAILWAY CARS

[75] Inventors: John C. Weiss, Johnstown; Cloyd F. Wirick, Mineral Point, both of Pa.

[73] Assignee: Johnstown America Corporation, Chicago, Ill.

[21] Appl. No.: 202,805

[22] Filed: Feb. 28, 1994

[51] Int. Cl.[5] ..... B61D 17/00

[52] U.S. Cl. ..... 105/406.1; 105/416

[58] Field of Search ..... 105/243, 244, 245, 246, 105/247, 248, 249, 250, 252, 253, 254, 255, 258, 251, 416, 417, 406.1, 406.2, 419

[56] References Cited

U.S. PATENT DOCUMENTS

| | | | |
|---|---|---|---|
| 703,659 | 7/1902 | Keithley | 105/249 |
| 728,051 | 5/1903 | Vanderbilt | 105/249 |
| 831,649 | 9/1906 | Bodds | 105/249 |
| 1,862,781 | 6/1932 | Wine | 105/247 |
| 1,881,797 | 10/1932 | Martin | 105/416 |
| 2,015,197 | 9/1935 | Shallenberger et al. | 105/249 |
| 3,538,857 | 11/1970 | Larssen | 105/247 |
| 3,584,564 | 6/1971 | Rollins | 105/247 |
| 4,493,266 | 1/1985 | Augustine, Jr. | 105/255 |
| 4,884,511 | 12/1989 | Hallam et al. | 105/247 |
| 5,115,748 | 5/1992 | Westlake | 105/245 |

FOREIGN PATENT DOCUMENTS

| | | | |
|---|---|---|---|
| 0882801 | 11/1981 | U.S.S.R. | 105/247 |

*Primary Examiner*—Mark T. Le

[57] ABSTRACT

A metal shroud for protecting the center sill of a rail car from contamination from bulk material being carried having a pair of pieces longitudinally split and arranged to be affixed in overlapping relationship to the center sill. The pair of pieces of the shroud have a generally L-shaped configuration and have overlapping horizontal end portions. The end portion of the first piece is offset to contact the end portion of the second piece.

10 Claims, 2 Drawing Sheets

TWO PIECE CENTER SILL SHROUD FOR RAILWAY CARS

BACKGROUND OF THE INVENTION

1. Field of the Invention

This invention relates in general to rail cars and, more specifically, to a two piece center sill shroud for railway cars.

2. Summary of the Prior Art

Gondola rail cars are designed to carry bulk material, such as coal, sand, gravel and the like. A well known gondola car is disclosed in U.S. Pat. No. 4,361,097 issued Nov. 30, 1982 to Jones et al. The gondola car described in the foregoing Jones et al patent includes a pair of lower longitudinal concave floors mounted on both sides of a longitudinal extending center sill. The center sill in a gondola car generally has a box-like cross sectional configuration and is constructed from steel, because of strength considerations to transmit draft and buff loads through the car.

As is well known, certain bulk material, such as coal, is corrosive to steel. In gondola cars, it is common practice to cover the center sill with an upper shroud of aluminum material to protect the center sill from contact with the bulk material being carried. Known shrouds are in the form of a single, elongated member generally enclosing the exposed portions of the center sill. The rigid construction of prior shrouds does not provide an optimum interconnection with the center sill and tub floor members of gondola cars. Such deficiencies in the attachment of the shroud to the center sill affects the effectiveness of protection of the center sill from corrosion and the ease of attachment of the shroud. Accordingly, it is desirable in the prior art to provide an improved shroud for protecting the center sill of a rail car.

SUMMARY OF THE INVENTION

It is an objective of the invention to provide an improved two piece center sill shroud for railway cars. The shroud herein includes a longitudinally split construction allowing the pieces to be affixed to the center sill with dimensional flexibility for allowing better fitting with the center sill and floor tubs of a gondola car. The two piece design of the invention not only provides more effective attachment to the center sill for improved protection against corrosion, but its flexibility allows for more efficient assembly.

DESCRIPTION OF THE PREFERRED EMBODIMENT

Figure 1:
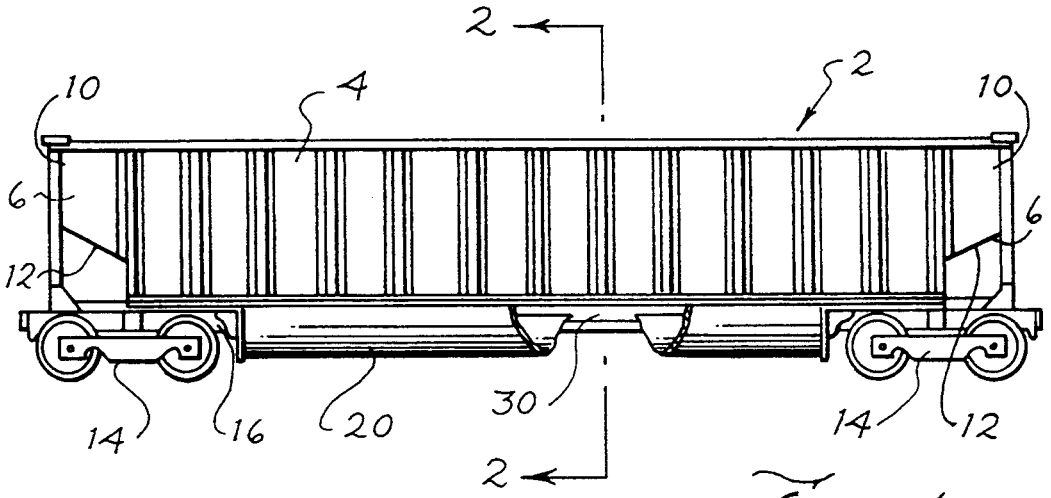
FIG. 1 is a side elevational view of a gondola rail car having the two piece center sill shroud of the invention.

Referring to FIG. 1, there is illustrated a gondola type rail car for carrying commodities, such as bulk material in the form of coal, sand, gravel and the like, and generally designated by reference numeral 2. The gondola car includes a pair of vertical side walls having vertical side sheets 4 and a pair of end walls and floor 6. The end walls and floor 6 have upper portions 10 and lower portions 12 which extend over conventional car truck assemblies 14 and distribute portions of the end loading.

Figure 2:
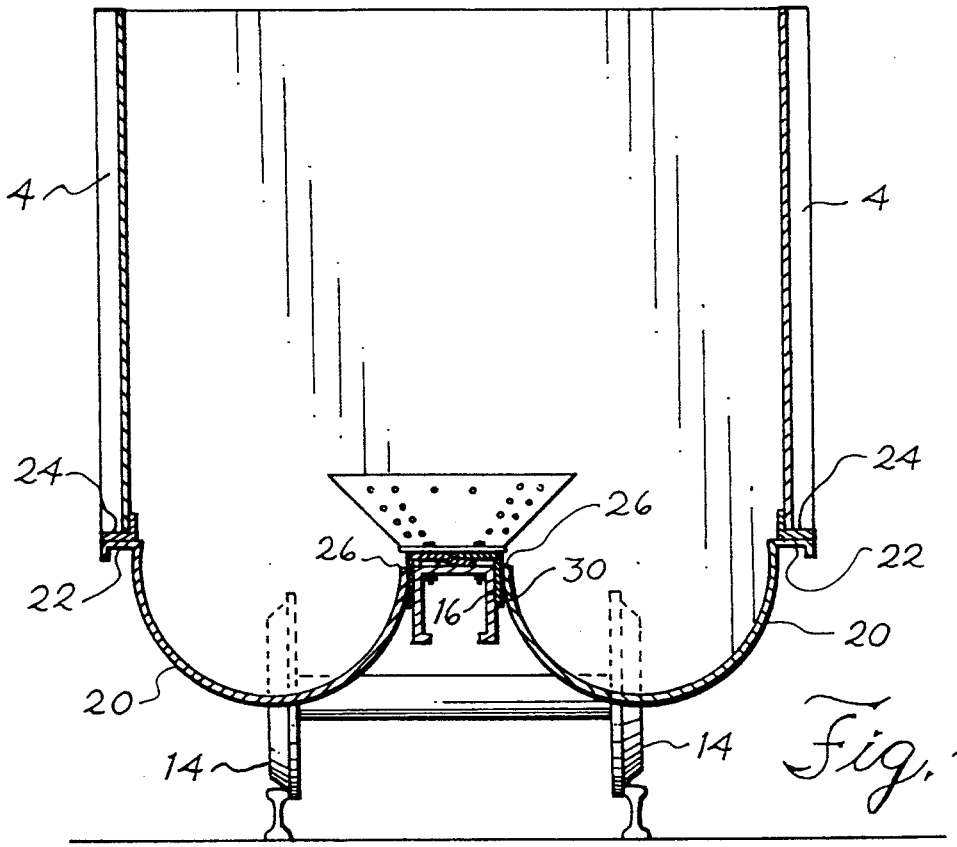
FIG. 2 is a partial end elevational view, with parts in section, of the rail car of FIG. 2 having the two piece center sill shroud.

As seen in FIGS. 1–4, a center sill 16 having a box beam shape extends substantially the full length of the car 2 between the trucks 14. The center sill 16 is fabricated from steel or other suitably strong load bearing material. A pair of metal concave floor panels 20 (FIGS. 1 and 2) in the form of a pair of tubs extending longitudinally on each side for a substantial length along center sill 16. As seen best in FIG. 2, the pair of tubs 20 are affixed along the outer edge portions 22 to the longitudinal side sill 24 as seen in FIG. 2. The inner edges 26 of tubs 20 are welded or bolted to respective sides of the center sill 16 as also seen in FIG. 2.

Figure 3:
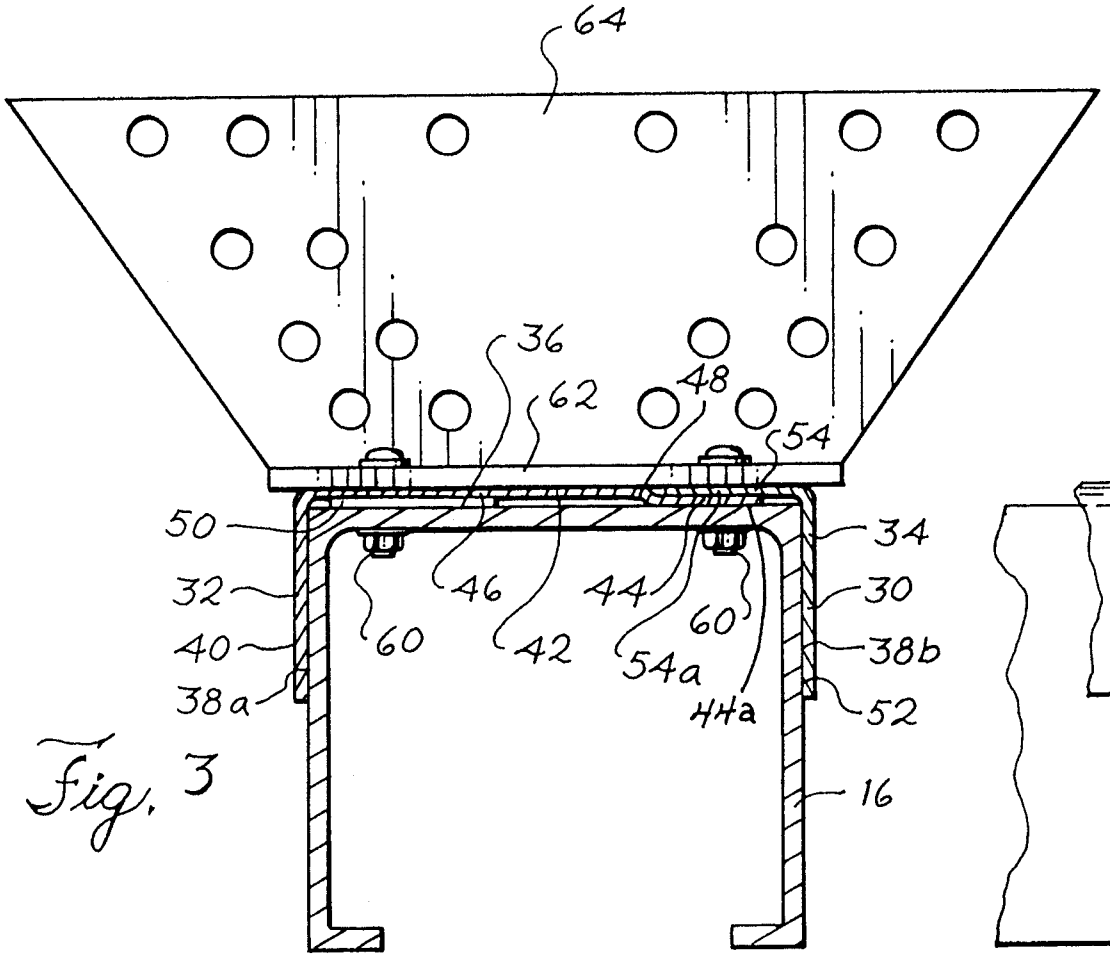
FIG. 3 is an enlarged partial end elevational view, with parts in section, of the two piece center sill shroud of the invention, taken along lines 3—3 of FIG. 4.

Referring now to FIG. 1 to 4, there is illustrated the two piece shroud 30 of the invention covering the top portion of center sill 16. The center sill shroud 30 may be fabricated from any suitable metal for protecting the steel center sill, such as aluminum. The shroud 30 includes interconnecting separate pieces 32 and 34 which cover the top surface 36 and upper side portions **38*a*, 38*b* substantially along the length of the center sill 16. Although the shroud 30 is described with reference to the gondola car 2 of FIG. 1, it is within the scope of the invention to use the shroud 30 in the other types of rail cars in which it is desirable to protect the center sill. The shroud piece 32 possesses a generally L-shaped cross-sectional configuration forming a vertical section 40 as an overlay on center sill side portion 38*a* and a horizontal section 42 for covering an area of top surface 36. As seen in FIG. 3, the horizontal section 42 includes an offset flat end portion 44 a confronting bottom surface 44*a* that bears against top surface 36. The intermediate horizontal portion 46 is integrally connected to end portion 44 at junction 48 and also has a flat configuration raised above the top surface 36 of center sill 16. As also seen in FIG. 3 a plurality of filler plates 50 (one of which is shown) of the same general thickness as end portion 44 is arranged between intermediate portion 46 and the top surface 36 of the center sill 16**.

The interconnecting piece 34 of shroud 30 comprises a L-shaped member having a vertical leg 52 covering upper side portion **38*b* and a horizontal leg 54 having an end portion 54*a* seating on at least a part of the upper surface of end portion 44 of piece 32. Because of the foregoing contact between the two pieces 32 and 34, adjustment of the relative positioning of the pieces is possible to compensate for variations in the width or longitudinal deviations of the center sill 16 for a better fit-up of the shroud 30**.

Figure 4:
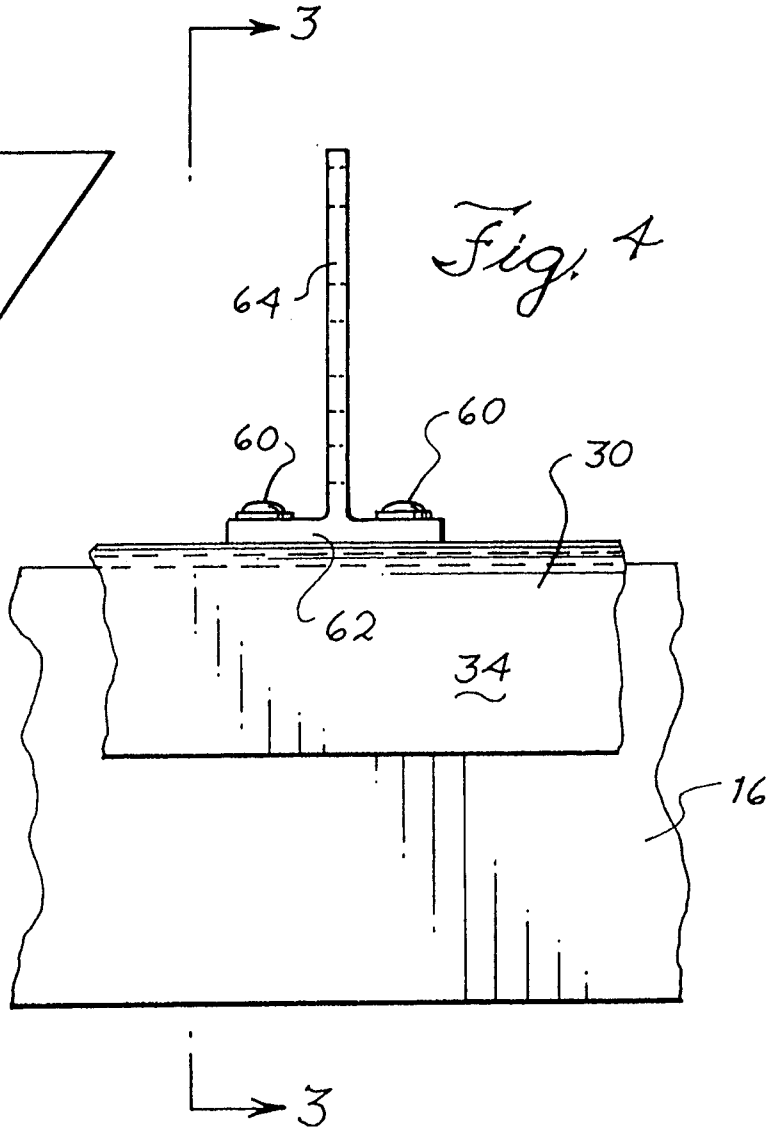
FIG. 4 is a partial side elevational view of two piece center sill shroud of the FIG. 2.

As seen in FIG. 3 and 4, the shroud 30 is bolted to the center sill 16 by four bolt assemblies 60 through a bar 62 which forms a part of the vertically oriented tie connection 64. The tie connection in 64 is affixed to the frame (not shown) of the rail car 2 at spaced positions longitudinally along the center sill 16. A plurality of fastening devices (not shown) respectively affixed the pieces 32 and 34 to the sides of center sill 16 substantially along at its length at a plurality of positions.

What is claimed is:

1. A rail car for carrying bulk material comprising a car body being carried by a pair of truck assemblies at two ends of the car body and forming a compartment for receiving bulk material, said car body having a center sill extending along the longitudinal center line of said car body through said compartment, shroud means being affixed to said center sill for covering the top portion of said center sill and protecting said center sill from contact with the bulk material being carried in said compartment, said shroud means includes separate first and second pieces being longitudinally interconnected along said center sill, said first pieces having a first portion confronting said center sill, and said second pieces having a second portion overlapping said first portion, above said first piece.

2. A rail car for carrying bulk material comprising a car body being carried by a pair of truck assemblies at two ends of the car body and forming a compartment for receiving bulk material, said car body having a center sill extending along the longitudinal center line of said car body through said compartment, shroud means being affixed to said center sill for covering the top portion of said center sill and protecting said center sill from contact with the bulk material being carried in said compartment, said shroud means includes separate first and second pieces being longitudinally interconnected along said center sill, said center sill includes flat side walls and a flat upper surface, and said first piece and second piece each includes a generally L-shaped cross-sectional configuration.

3. The rail car according to claim 2 wherein said first piece includes a vertical section for contacting at least a portion of one of said side walls of said center sill, said first piece further includes a horizontal section forming a flat portion for contacting an area of said center sill.

4. The rail car of claim 3 wherein said second piece includes vertical section for contacting the other side wall of said center sill, said second piece having a horizontal section overlaying said horizontal section of said first piece.

5. The rail car according the claim 4 wherein said horizontal section of said first piece includes an end portion lying in a plane offset below an intermediate portion of said first piece.

6. The rail car according to claim 5 wherein said end portion of said horizontal section of said first piece forms said center sill contacting portion.

7. The rail car according to claim 6 wherein a part of said horizontal section of said second piece overlays at least a portion of the top of said end portion of said first piece.

8. The rail car according to claim 7 wherein said intermediate portion of said first piece is spaced above said top surface of said center sill.

9. The rail car according to claim 8 further including a filler plate imposed between a part of said intermediate portion of said first piece and said top surface of said center sill.

10. A rail car for carrying bulk material comprising a car body being carried by a pair of truck assemblies at two ends of the car body and forming a compartment for receiving bulk material, said car body having a center sill extending along the longitudinal center line of said car body through said compartment, shroud means being affixed to said center sill for covering he top portion of said center sill and protecting said center sill from contact with the bulk material being carried in said compartment, said shroud means includes separate first and second pieces being longitudinally interconnected along said center sill, said first piece having a portion longitudinally extending over said center sill, and said second piece having a longitudinal portion overlying said portion of said first piece in confronting relationship.

* * * * *